United States Patent [19]

Yoshida

[11] 4,018,180

[45] Apr. 19, 1977

[54] SYSTEM FOR BUILDING AND LAUNCHING SHIPS

[75] Inventor: Toshio Yoshida, Kobe, Japan

[73] Assignee: Kawasaki Jukogyo Kabushiki Kaisha, Kobe, Japan

[22] Filed: Mar. 26, 1976

[21] Appl. No.: 670,975

[30] Foreign Application Priority Data

Apr. 1, 1975 Japan ..... 50-40095

[52] U.S. Cl. ..... 114/65 R; 61/64

[51] Int. Cl.[2] ..... B63B 3/00

[58] Field of Search ..... 114/65 R, 77 R, 77 A; 61/64, 67

[56] References Cited

UNITED STATES PATENTS

| | | | |
|---|---|---|---|
| 1,398,825 | 11/1921 | Affaire | 61/64 |
| 3,489,118 | 1/1970 | Sugizaki et al. | 114/65 R |

FOREIGN PATENTS OR APPLICATIONS

| | | | |
|---|---|---|---|
| 565,526 | 3/1958 | Belgium | 61/64 |
| 619,804 | 4/1927 | France | 61/64 |

*Primary Examiner*—Trygve M. Blix
*Assistant Examiner*—Jesus D. Sotelo

[57] ABSTRACT

At least one ship building berth space is provided on the ground adjacent to a dock facing open water. When a ship is built in the berth space, temporary partitioning walls are set up in a manner surrounding the berth space and the dock, and water is supplied into the area surrounded by the walls to cause the ship to float off the floor of the berth space, whereby the ship can be floatingly moved into the dock and then can be launched into the open water.

1 Claim, 25 Drawing Figures

SYSTEM FOR BUILDING AND LAUNCHING SHIPS

BACKGROUND OF THE INVENTION

This invention relates generally to techniques in building and launching ships and more particularly to a system whereby ships are built and launched with efficient utilization of the dock and ship building areas associated therewith.

The methods of building and launching ships can be roughly divided into two categories, one utilizing an inclined ship-building slip or berth from which a completed ship is launched into the sea or open water, and the other utilizing a ship-building dock from which a completed ship is launched by opening the dock gate and filling the dock with water.

In either of these cases, the floor areas on which ships are built should have sufficient strength to bear the weight of the ships, and for the purpose of efficiently utilizing these ship building floor areas, various methods have been proposed.

According to one of these methods often referred to as a block ship-building method, various sections of a ship constructed separately at different ship building areas are transported to a ship-building berth or to a ship-building dock to be finally assembled into a ship therein, thereby to shorten the ship building period in the berth or dock and to effectively utilize the berth or dock of high building cost only for the assembly of a ship at the final stage.

According to another method, in view of the fact that the stern part of a ship which includes an engine room requires a longer construction period than the other parts of the ship, the stern part is constructed separately in an area adjacent to the ship building berth and then shifted to the berth, and, subsequently, the remaining part of the ship is constructed in the berth. Otherwise, while a first ship is being constructed in a ship building dock, the stern part of a second ship is also constructed separately in the same ship building dock, and after the first ship has been completed and launched, the stern part of the second ship is utilized to complete the second ship which is to be launched after the launching of the first ship.

A further method of building and launching ships is disclosed in Japanese patent publication No. 25893/1971 (Pat. No. 642,908) entitled "ship Hull Construction Method and System." According to this method, a dry dock whose two ends are openable toward open water through respective gates is provided, and while a first ship is being constructed in the dry dock, the stern part of a second ship, which is to be launched after the launching of the first ship, is also constructed in the same dry dock in tandem relationship to the first ship, whereby the period for building the second ship with its hull occupying substantially the entire area of the dry dock is shortened, and the utilization of the dry dock is made more efficient.

A characteristic feature of this method is that the construction of the stern part of the second ship is started at one of the two longitudinally opposite end positions in the dry dock selected alternately while the construction of the first ship is carried out in the remaining part of the dock, and when the first ship is completed it is launched through the dock gate at the other end position of the dock while when the second ship is completed it is launched through the dock gate at the one end position of the dock. When the first ship is to be launched, an intermediate removable gate is installed to divide the dock into two sections, containing the first ship and the stern part of the second ship, respectively, and water is introduced into the one section of the dock in which the first ship is positioned, so that the first ship can be launched through the gate associated with the one section of the dock.

In all of the above described known methods and systems, a dry dock of high cost of construction and use is used and occupied for a long period for the construction of a ship, and it cannot be used for other ships as long as the ship is being constructed. In this sense, the known methods and systems are not economical.

SUMMARY OF THE INVENTION

An object of this invention is to provide a system for building and launching ships whereby the efficiency in using a dock can be improved and the construction cost of ship-building yards can be substantially reduced.

Another object of this invention is to provide a system for building and launching ships whereby a plurality of ships can be built concurrently by the use of a single dock.

Still another object of this invention is to provide a system for building and launching ships whereby the building of ships is facilitated because ships being built can be placed on level ground.

A further object of this invention is to provide a system for building and launching ships wherein the costly dock can be used in turn for repairing and inspecting ships and for launching ships built in ship building berth spaces provided adjacent to the dock, so that the dock is not occupied by a single ship being built for long period.

According to one aspect of the invention, there is provided a system for building and launching ships including a dock having a gate facing open water, the system comprising at least one ship building berth space means located adjacent to the dock and having a floor at a level higher than the bottom of the dock, water retaining wall means surrounding the dock and berth space means for retaining water therein, and water supplying and draining means for supplying water into the dock and berth space to such a level that a ship placed in the berth space means is floated off the floor of the space means and for draining the water to the same level as that of the open water, whereby the ship can be floatingly moved from within the berth space means into the dock and then into the open water.

The invention will be made clearer from the following detailed description of preferred forms of the invention when read in conjunction with the accompanying drawings, wherein like parts or components are designated by like reference numerals and characters.

DETAILED DESCRIPTION OF THE INVENTION

Figure 1:
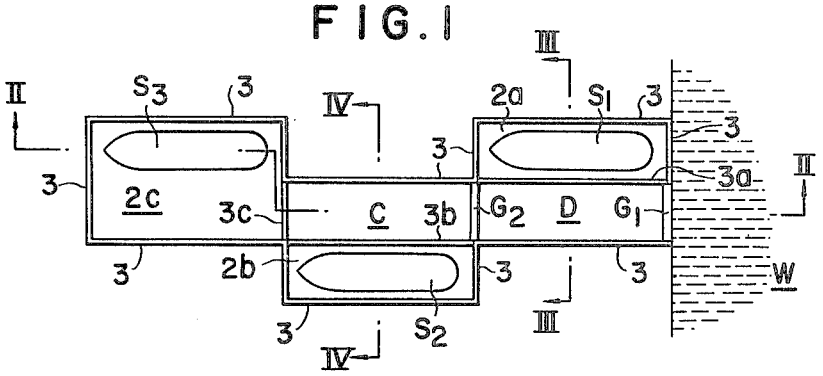
FIG. 1 is a schematic plan view showing an example of a ship building and launching system according to this invention.

Referring now to FIG. 1 showing a ship building and launching facility or system constituting a first embodiment of this invention, there is provided a dry dock D of a conventional construction opening toward a body of outside open water or sea W, and separated therefrom by a gate $G_1$. By opening the gate $G_1$, the dry dock D is communicated with the open water W.

Figure 3:
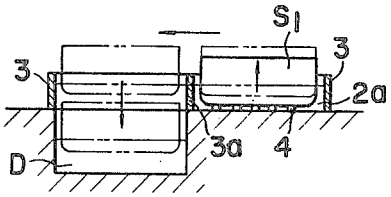
FIG. 3 is another elevational section taken along the line III—III in FIG. 1.

Laterally adjacent to the dry deck D, there is provided a ship hull construction berth space 2*a*. The space 2*a* has a floor level higher than the bottom surface of the dry dock D as is indicated in FIG. 3, and is surrounded by partition walls 3 and 3*a*. The floor of the berth space 2*a* is at the same level as the ground surface surrounding the dock D. The partition walls 3 may be permanent walls, made of, for instance, concrete, based on the ground, or may preferably be of a temporary construction freely detachable from the ground as described hereinafter. The partition wall 3*a* directly adjacent to the dock D should be of a movable temporary construction. On the side of the dock D opposite to the partition wall 3*a* is also provided another partition wall 3. Within the berth space 2*a*, a ship hull $S_1$ is constructed.

Figure 2:
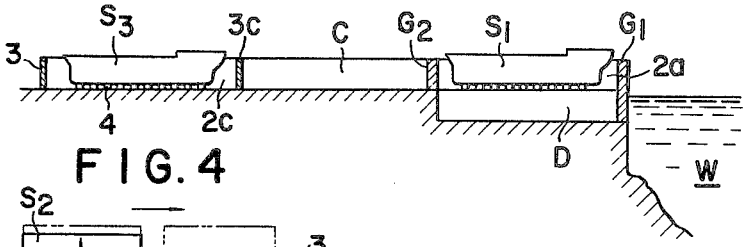
FIG. 2 is an elevational section taken along the line II—II in FIG. 1.

Adjacent to the longitudinal end of the dock D, opposite to its end opening toward the open water W, there is provided a waterway space C connected to the dock D through another gate $G_2$ interposed therebetween. When the gate $G_2$ is opened, the waterway space C is communicated with the dock D. As shown in FIG. 2, the waterway space C has a bottom surface at a level higher than the bottom of the dock D. In this example, the bottom surface of the waterway space C is at the same level as the ground surface surrounding the dock D. The waterway space C is surrounded by the gate $G_2$ and partition walls 3, 3*b*, and 3*c*, of which the walls 3*b* and 3*c* are made freely detachable or removable as in the case of the partition wall 3*a*.

Figure 4:
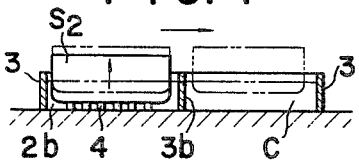
FIG. 4 is still another elevational section taken along the line IV—IV in FIG. 1.

Laterally contiguously to the waterway space C, another berth space 2*b* for building ship hulls is provided. The bottom of the berth space 2*b* is at a level equal to that of the bottom of the waterway space C, as shown in FIG. 4, and the hull of a ship $S_2$ is built in the space 2*b*.

Extending contiguously to the end of the waterway space C remote from the open water W, there is provided still another berth space 2*c* which is surrounded by partition walls 3 and 3*c*. The bottom of the berth space 2*c* is also at the same level as that of the waterway space C as is apparent in FIG. 2. The berth space 2*c* accommodates a ship $S_3$. The berth spaces 2*a*, 2*b*, and 2*c* are provided with base blocks 4 for supporting the ships $S_1$, $S_2$, and $S_3$ thereon, respectively. Because the berth sapces 2*a*, 2*b*, and 2*c* and the waterway space C are filled with water when it is required, as will be described later, the bottoms thereof are preferably treated for preventing or reducing permeation of water thereinto.

Figure 5:
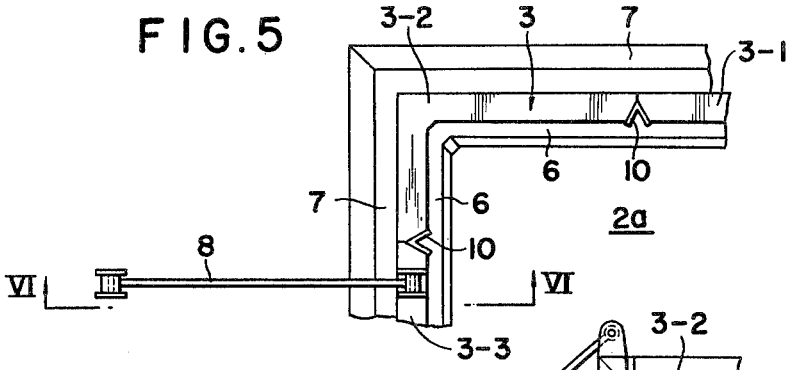
FIG. 5 is a fragmentary plan view showing a ship-building berth space and a movable type partition wall surrounding the berth.
Figure 6:
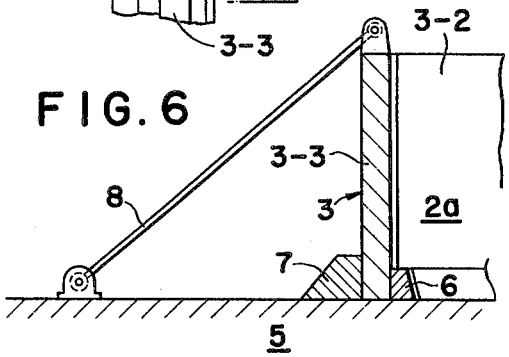
FIG. 6 is an elevational section taken along the line VI—VI in FIG. 5.

In FIGS. 5 and 6, an example of the detachable type partition wall 3 is illustrated. The illustrated construction of the partition wall 3 is, of course, applicable to the detachable partition walls 3*a*, 3*b*, and 3*c*. The partition wall 3 comprises a number of partition wall panels or elements 3-1, 3-2, 3-3, and so on. The partition wall elements are assembled together in a manner such that the side edges thereof are in abutment against each other.

Inside of the partition elements (berth space side), inner buttress blocks 6 are affixed to the ground in a suitable manner, and on the outside of the same elements, outer buttress blocks 7 are also affixed to the ground in a similar manner. The lower edges of the partition elements are detachably inserted into the gap formed between the inner and outer buttress blocks 6 and 7. Bracing struts 8 is provided between the top of each partition element and outside anchors on the ground, so that the element is thereby supported in a stable manner to resist the load from the water in the space 2*a*.

Figure 7:
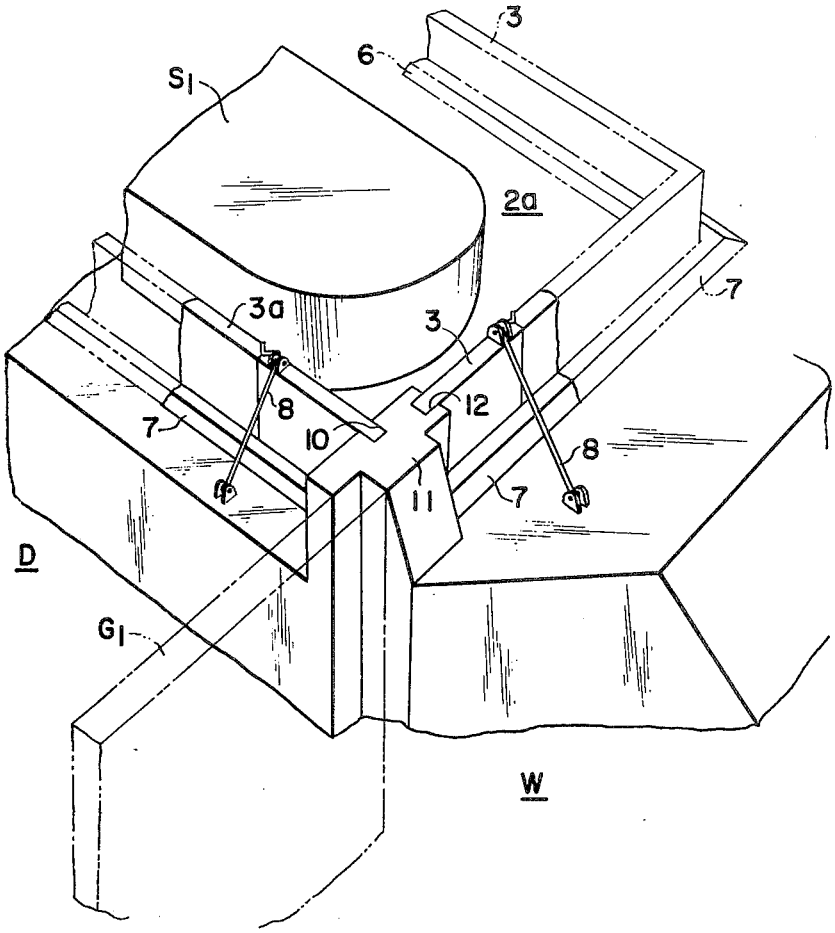
FIG. 7 is a fragmentary perspective view showing a dock and a ship-building berth space adjacent thereto, shown in FIG. 1.

In FIG. 7, there is illustrated schematically part of the dock D, facing the open water and the berth space 2*a* shown in FIG. 1, with the remaining part thereof cut away. The gate G 1 of the dock D is of a height greater than that of the ordinary dock gate, so that a water level higher than that of the outside open water W can be maintained within the dock D. One end of the partition wall 3*a* is engaged in a vertical groove 10 of a permanent concrete structure 11, and likewise one end of the partition wall 3 is engaged in a vertical groove 12 of the structure 11.

The above described ship building and launching system can be used as follows.

Figure 8:
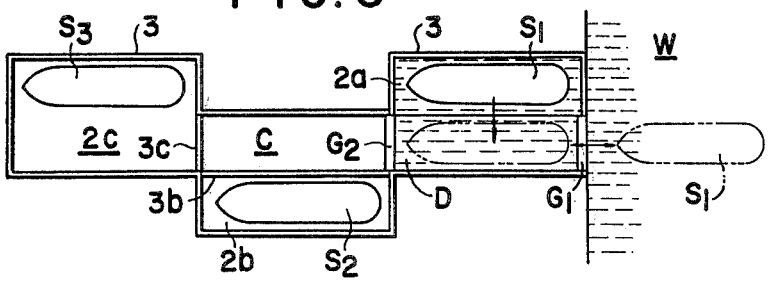
FIG. 8 is a schematic plan view of the system shown in FIG. 1, explanatory of how a ship built in a berth space is launched via the dock.

In the case where a ship $S_1$ built in the berth space 2*a* is to be launched, the gates $G_1$ and $G_2$ are closed, and the partition walls 3 surrounding the berth space 2*a* and the dock D are set up. In this case, however, the partition wall 3*a* between the dock D and the berth space 2*a* is not set up, and the entire area of the dock D and the berth space 2*a* is filled with water, as indicated in FIG. 8, by pumping means (not shown). When the water level in the area rises and the ship $S_1$ is floated until its bottom is lifted from the bottom of the berth space 2*a* by a distance sufficient to allow the movement of the ship $S_1$, the latter is moved laterally in the arrow-marked direction in FIG. 8 toward the dock D by towing means such as a winch. After the ship $S_1$ has been moved into the dock D, the water level in the area is then lowered to that of the outside open water W, and thereafter the gate $G_1$ is opened to launch the ship $S_1$ into the open water W.

Figure 9:
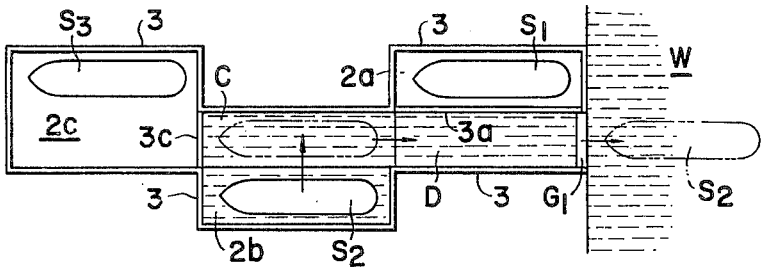
FIG. 9 is a view similar to FIG. 8, showing how a ship built in another berth space is launched through a waterway and dock.

At the time when the ship $S_2$ is to be launched, the partition walls 3*a* and 3*c* are set up, while the partition wall 3*b* is not set up, and the gate $G_1$ is closed while the gate $G_2$ is opened. Thereafter, the entire area including the dock D, waterway space C, and the berth space 2*b* is filled with water as shown in FIG. 9 until the ship $S_2$ if floated on the water. The ship $S_2$ is then moved laterally in the arrow direction into the waterway space C and then into the dock D, and the water level in the area is lowered to that of the open water W. The gate $G_1$ is then opened, and the ship $S_2$ is launched into the open water W.

Figure 10:
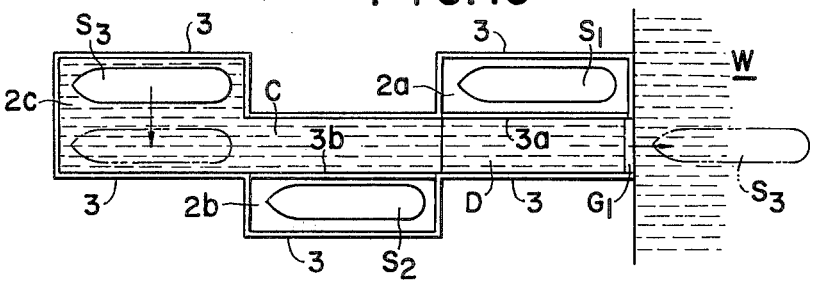
FIG. 10 is a view similar to FIG. 8, showing how a ship built in still another berth space is launched through the waterway and the dock.

Likewise, when it is required to launch the ship $S_3$ built in the berth space 2*c*, the partition walls 3*a* and 3*b* are set up, gate $G_1$ is closed, gate $G_2$ is opened, and the partition wall 3*c* is removed. After that, the area including the dock D, waterway space C, and the berth space 2*c* is filled with water, as shown in FIG. 10. The ship $S_3$ is moved through the waterway space C into the dock D, and then the water level in the area is lowered to that of the open water W. The gate $G_1$ is thereafter opened, and the ship $S_3$ is launched into the open water W.

Figure 11:
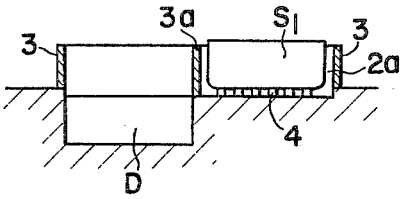
FIG. 11 is an elevational view in vertical section, similar to FIG. 3, but showing a modification of the system shown in FIGS. 1 through 4.
Figure 12:
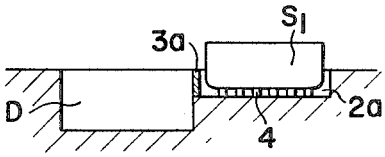
FIG. 12 is an elevational view in vertical section, similar to FIG. 3, but showing another modification of the system shown in FIGS. 1 through 4.
Figure 13:
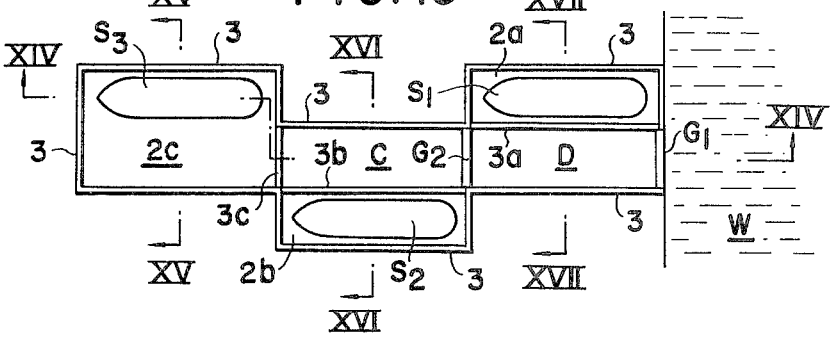
FIG. 13 is a schematic plan view showing a second embodiment of the invention.
Figure 14:
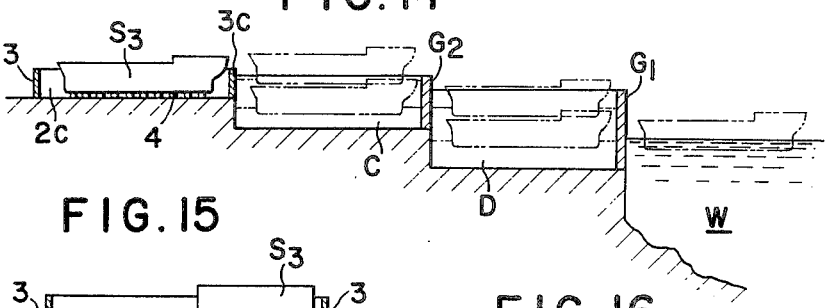
FIG. 14 is an elevational section taken along the line XIV—XIV in FIG. 13.
Figure 15:
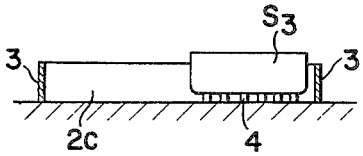
FIG. 15 is an elevational section taken along the line XV—XV in FIG. 13.
Figure 16:
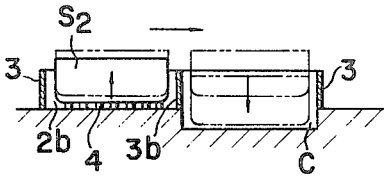
FIG. 16 is an elevational section taken along the line XVI—XVI in FIG. 13.

FIGS. 11 and 12 illustrate two modifications of the first embodiment of the invention shown in FIGS. 1, 2, 3 and 4. In the first modification shown in FIG. 11, the floors of the berth spaces 2*a*, 2*b*, and 2*c* are made somewhat lower than the level of the surrounding ground, whereby the height of the partition walls 3, 3*a*, 3*b*, and 3*c* can be reduced for economization of materials.

In the second modification shown in FIG. 12, the floors of the berth spaces 2*a*, 2*b*, and 2*c* are further lowered, so that the partition walls 3 are no more required, while the partition walls 3*a*, 3*b* and 3*c* can be considerably lowered.

In FIGS. 13 through 17, there is illustrated a shipbuilding and launching system constituting the second embodiment of this invention. In this embodiment, the bottom of a waterway space C adjacent to the dry dock D is at a level lower than that of the floor of the berth space 2*c*, which floor is at the level of the ground surrounding the system.

Figure 17:
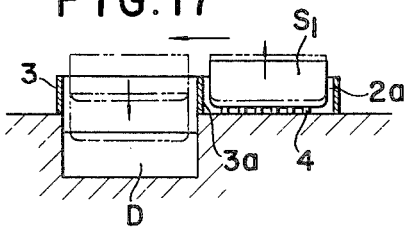
FIG. 17 is an elevational section taken along the line XVII—XVII in FIG. 13.
Figure 18:
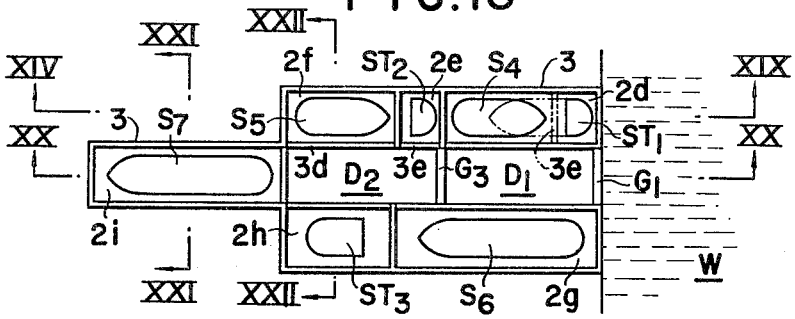
FIG. 18 is a schematic plan view showing a third embodiment of the invention.
Figure 19:
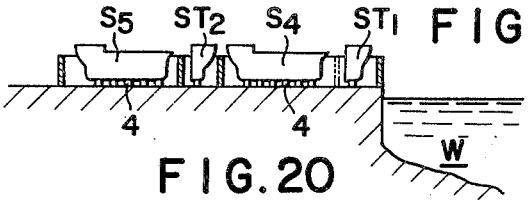
FIG. 19 is an elevational section taken along the line XIX—XIX in FIG. 18.
Figure 20:
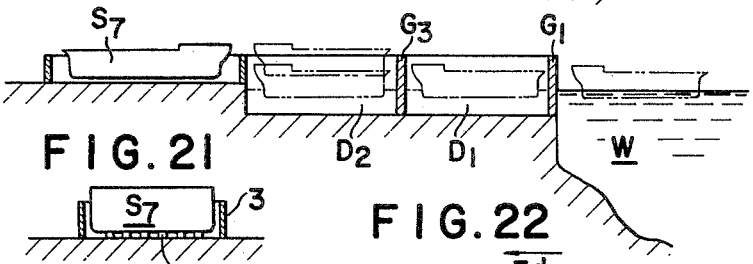
FIG. 20 is an elevational section taken along the line XX—XX in FIG. 18.
Figure 21:
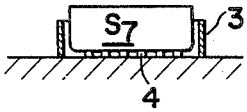
FIG. 21 is an elevational section taken along the line XXI—XXI in FIG. 18.
Figure 22:
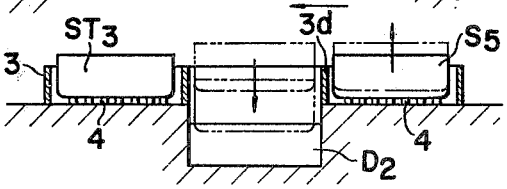
FIG. 22 is an elevational section taken along the line XXII—XXII in FIG. 18.

In the case where a ship $S_1$ built in the berth space 2*a* is to be launched, the dock D and the berth space 2*a* are filled with water, as in the first embodiment of the invention, to a level such that the ship $S_1$ is floated and can be moved into the dock D as shown in FIG. 17. After the ship $S_1$ has been shifted to the dock D, the water level in the dock D is lowered to that of the outside open water W as also shown in FIG. 17, and the ship $S_1$ is launched from the dock D into the open water W.

When the ship $S_2$ built in the berth space 2*b* is to be launched, the gate $G_2$ is closed and the partition wall 3*c* is set up. The area including the berth space 2*b* and the waterway space C is thereafter filled with water to a level such that the ship $S_2$ is floated and can be moved into the waterway space C. After the ship $S_2$ has been shifted into the waterway space C, the water level in the waterway space C is lowered to a level such that the bottom of the ship $S_2$ is slightly above the bottom of the waterway space C, and then water is introduced into the dock D until the water level in the dock D becomes equal to that in the waterway space C. Thereafter, the gate $G_2$ is opened and the ship $S_2$ is moved into the dock D. The water level in the dock D is then lowered to that of the open water W, and after the gate $G_1$ is opened the ship $S_1$ is launched into the open water. As for the launching of the ship $S_3$, the spaces 2*c* and C are first filled with water with the wall 3*c* removed and the gate $G_2$ closed, and then the ship $S_3$ is moved into the waterway space C. Thereafter, the same procedure as above described in connection with the launching of the ship $S_2$ is carried out.

It will be apparent to those skilled in the art that the same modifications as those described with reference to FIGS. 11 and 12 may also be made in this embodiment of the invention for realizing economy of wall material as well as the energy for pumping up water.

A third embodiment of the present invention, shown in FIGS. 18 through 22, differs from the first embodiment of the invention, in that an intermediate gate $G_3$ is provided in a dock thereby dividing the dock into two dock sections $D_1$ and $D_2$, and two berth spaces are arranged on the ground level of respective lateral sides of the dock sections $D_1$ and $D_2$. The berth space on one lateral side of the dock sections $D_1$ and $D_2$ is defined by partition walls 3, 3*d* and so on, similar to the partition walls shown in FIGS. 5 and 6 and divided into a number of berth space sections 2*d*, 2*e* and 2*f* by means of a number of sub-partition walls extending transversely to the berth space. Likewise, the berth space on the other lateral side of the dock sections $D_1$ and $D_2$ is defined by partition walls similar to the partition walls shown in FIGS. 5 and 6, and divided into two berth space sections 2*g* and 2*h* by means of sub-partition walls extending transversely to the berth space. Adjacent to one longitudinal end of the dock section $D_2$, there is provided another berth space 2*i*.

In the berth space sections 2*d*, the stern part $ST_1$ of a ship and another ship $S_4$ are constructed concurrently. The berth space sections 2*e*, 2*f*, 2*g* and 2*h* accommodate therein the stern part $ST_2$ of a ship, a ship $S_5$, a ship $S_6$ and the stern part $ST_3$ of a ship, respectively, while the berth space 2*i* accommodates a ship $S_7$.

Figure 23:
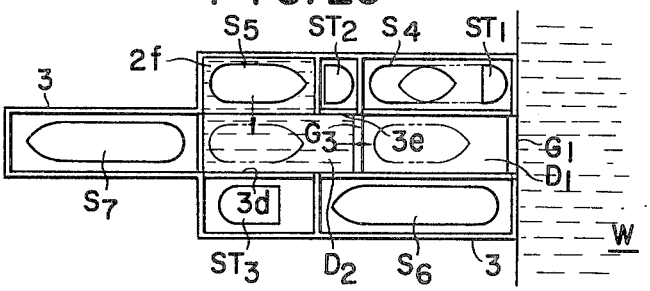
FIG. 23 is a plan view similar to FIG. 18, but showing show a ship built in a berth space is transversely shifted into a section of the dock.

When the ship $S_5$ is to be launched, an area including the berth space section 2*f* and the dock section $D_2$ is filled with water, and the ship $S_5$ is first moved into the dock section $D_2$ as shown in FIG. 23. After the water level in the dock section $D_2$ is lowered, the gates $G_3$ and $G_1$ are opened in this order and the ship is launched into the open water.

It will be understood that as for the ships $S_4$, $S_6$ and $S_7$, similar procedures can be taken for the launching thereof.

According to this embodiment of the invention, the stern parts $ST_1$, $ST_2$ and $ST_3$ are constructed while the ships $S_4$, $S_5$ and $S_6$ are being built. For example, in the berth space section 2*d*, the stern part $ST_1$ of a ship, which is to be launched after the launching of the ship $S_4$, is constructed. As described hereinbefore, the construction of the stern part of a ship needs a longer period than the other parts of the ship. When the ship $S_4$ is ready for launching, a sub-partition wall 3*e* is set up in the berth space section 2*d*, and water is introduced into the area of the section 2*d* other than the area where the stern part $ST_1$ is placed. After the launching of the ship $S_4$, the sub-partition wall 3*e* is removed, and the ship to be launched thereafter is constructed in continuation of the stern part $ST_1$ as shown in phantom line in FIG. 18. It will be understood that the same procedure can be taken with respect to the other stern parts.

Figure 24:
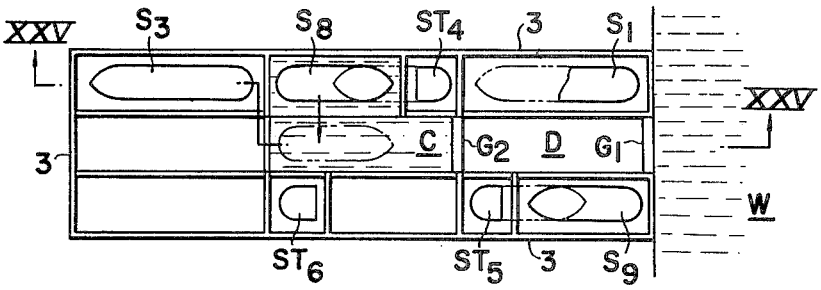
FIG. 24 is a schematic plan view showing a fourth embodiment of the invention.
Figure 25:
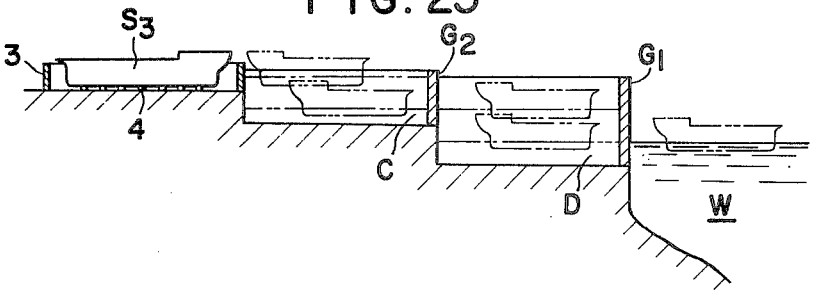
FIG. 25 is a section taken along the line XXV—XXV in FIG. 24.

A fourth embodiment of the invention is illustrated in FIGS. 24 and 25. This embodiment of the invention differs from the second embodiment of the invention shown in FIGS. 13 through 17 in that ship building berth spaces are arranged so as to surround the dock D and the waterway space C except at the end of the dock facing the open water W, and that the berth spaces on both lateral sides of the dock D and the waterway C are each divided into berth space sections by means of transverse sub-partition walls as in the third embodiment of the invention. It will be noted from these figures that these berth spaces accommodate therein a ship $S_1$, a stern part $ST_4$, a ship $S_8$, a ship $S_9$, stern parts $ST_5$ and $ST_6$, and a ship $S_3$. It will be apparent from the description of the foregoing embodiments of the invention how these ships are launched and the stern parts are constructed for completion of ships and then launched.

According to the present invention, ships are built concurrently in a number of berth spaces on the ground, of relatively low construction cost, whereby the costly dry dock can be used only for launching the ships built in the berth spaces. As a result, the dry dock can be used mostly for repair and inspection of other ships, and utilization of the dry dock can be substantially improved.

I claim:

1. A system for building and launching ships comprising a first dock having a first gate facing open water; a second dock disposed adjacent to and in alignment with said first dock, a second gate connecting said second dock to the end of the first dock remote from said first gate; a plurality of side ship building berth space means located laterally adjacent to said first and second docks; an end ship building berth space means located adjacent to the end of the second dock remote from said second gate, said side and end ship building berth space means having floors at a ground level higher than the bottom of the docks; detachable water retaining wall means surrounding the docks and all the berth space means, respectively, for retaining water therein; detachable sub-partitioning wall means dividing the space of at least one of said berth space means into at least two berth space sections to enable selective retention of water in only one of the two berth space sections; said water retaining wall means comprising a plurality of wall panels erected on the ground with side edges thereof in sealing abutment with each other; buttresseblocks disposed adjacent to the inner and outer lower edges of said wall panels to detachably receive therebetween the lower edges of the wall panels, and bracing struts connected between the top of each wall panel and outside anchors on the ground; said docks and berth space means being dimensioned to be supplied with water therein to such a level that a ship placed in any of the berth space means is floated off the floor thereof, such that the ship can be floatingly moved from within the berth space means to the open water through at least said first dock.

* * * * *